United States Patent [19]

Kohl

[11] 4,376,018

[45] Mar. 8, 1983

[54] ELECTRODEPOSITION OF NICKEL

[75] Inventor: Paul A. Kohl, Chatham, N.J.

[73] Assignee: Bell Telephone Laboratories, Incorporated, Murray Hill, N.J.

[21] Appl. No.: 307,900

[22] Filed: Oct. 2, 1981

Related U.S. Application Data

[62] Division of Ser. No. 108,964, Dec. 31, 1979, Pat. No. 4,310,392.

[51] Int. Cl.[3] ..... C25D 3/18

[52] U.S. Cl. ..... 204/49

[58] Field of Search ..... 204/49, 43 T, 112, 123, 204/44, 45 R

[56] References Cited

U.S. PATENT DOCUMENTS

| | | | |
|---|---|---|---|
| 2,469,727 | 5/1949 | Hoffman | 204/49 |
| 2,748,068 | 5/1956 | Faust et al. | 204/49 X |
| 2,782,155 | 2/1957 | DuRose et al. | 204/49 |
| 3,661,730 | 5/1972 | Nishihara | 204/43 S |
| 3,663,378 | 5/1972 | Brown | 204/49 |
| 3,686,239 | 8/1972 | Passal | 204/49 X |
| 3,749,649 | 7/1973 | Valayil | 204/43 S |
| 3,875,029 | 4/1975 | Rosenberg et al. | 204/43 S |
| 3,956,123 | 5/1976 | Rosenberg et al. | 204/54 R |
| 3,990,955 | 11/1976 | Dill | 204/49 |
| 4,000,047 | 12/1976 | Ostrow et al. | 204/43 S |
| 4,089,755 | 5/1978 | Steinecker | 204/55 R |
| 4,160,707 | 7/1979 | Helle et al. | 204/49 X |

FOREIGN PATENT DOCUMENTS

| | | | |
|---|---|---|---|
| 1143075 | 1/1963 | Fed. Rep. of Germany | 204/52 Y |
| 51-1330 | 8/1976 | Japan | 204/49 |

OTHER PUBLICATIONS

Robert Weiner, APC SN. 351,241, May 18, 1943.

Abner Brenner, "Electrodeposition of Alloys", vol. II, pp. 4–29, (1963).

A. Kenneth Graham et al., Tech. Proc. Am. Electroplater's Soc., vol. 50, pp. 139–146, (1963).

*Primary Examiner*—G. L. Kaplan

*Attorney, Agent, or Firm*—Walter G. Nilsen

[57] ABSTRACT

Nickel is electroplated from a bath comprising such additives as phenolphthalein, lactones, lactams, cyclic sulfate esters, cyclic imides and cyclic oxazolinones. These additives permit high plating rates, smooth bright finishes, freedom from dendritic growth and constant plating thicknesses over wide areas.

6 Claims, No Drawings

ELECTRODEPOSITION OF NICKEL

This application is a division of application Ser. No. 108,964, filed Dec. 31, 1979, now U.S. Pat. No. 4,310,392.

TECHNICAL FIELD

The invention involves electroplating of metals and alloys including zinc, copper, cadmium, chromium, nickel, cobalt, gold, silver, palladium, platinum, ruthenium and alloys of these metals with each other and with other substances such as tin and lead.

BACKGROUND OF THE INVENTION

Deposits of various materials and alloys are extensively used in a wide variety of functional and decorative applications. Typical metals are zinc, copper, cadmium, chromium, nickel, cobalt, gold, silver, palladium, platinum, ruthenium, and alloys of these metals with each other and with tin and lead. These materials and alloys are often used on decorative and functional articles to prevent tarnishing surface corrosion, or to provide a smooth, lustrous surface.

These electrolytic deposits are also used in a large variety of electronic surfaces, electronic devices, and electronic conductors. They are used as protective layers to prevent corrosion of other underlying materials and to maintain good surface electrical contact. Such deposits are also used in the fabrication of integrated circuits and to provide conducting paths and places to mount electronic components. Such uses are increasing rapidly and represent an important commercial use of electrolytic deposition processes.

Commercially, it is highly desirable to be able to plate very rapidly and maintain good quality deposits for the particular application at hand. Smooth deposits are particularly important because it yields good surface electrical contacts and insures low porosity for the plating thickness attained. In addition, it is desirable to have relatively constant plating thickness so as to ensure complete coverage without excessive build-up of plating thickness.

In the fabrication of integrated circuits where close dimensional tolerances are required, it is highly desirable to have smooth platings with constant thickness. A particular freedom from dendritic growth precludes any chance of shorts across conductive paths from needle growth. In addition, constant plating thickness is highly advantageous to obtain the close tolerances required.

Various references have disclosed the use of additives to electroplating solutions. Some of these references are: W. E. Rosenberg, et al., U.S. Pat. No. 3,956,123, issued May 11, 1976; S. P. Valayil, U.S. Pat. No. 3,749,646, issued July 31, 1973; K. Nishihava, U.S. Pat. No. 3,661,730, issued May 9, 1972; B. D. Ostrow, et al., U.S. Pat. No. 4,000,047, issued Dec. 28, 1976; and W. F. Rosenberg, et al., U.S. Pat. No. 3,875,029, issued Apr. 1, 1975.

SUMMARY OF THE INVENTION

The invention is a process for electroplating metals and alloys in which the plating solution contains one or more additives selected from a special class of organic compounds. This class of compounds are lactones (cyclic esters), lactams (cyclic amides), cyclic sulfate esters, (sulfones) cyclic imides and cyclic oxazolinones, with at least one aromatic ring and up 100 carbon atoms. For convenience, these compounds are referred to as "heterocyclic additives". The aromatic ring may contain a variety of substituents, including hydroxy groups, alkoxy groups, amine groups, carboxylic acid groups, halide groups, aliphatic and aromatic groups with up to 10 carbon atoms. The plating bath may contain other organic compounds such as one or more of the aromatic or aliphatic polyethers. Particularly useful are the polyalkoxylated alkyl phenols such as octylphenoxy(10-)polyethoxyethanol. These additives may be used in a wide variety of electroplating processes including electroplating such metals as zinc, copper, cadmium, chromium, nickel, cobalt, gold, silver, and alloys of these metals with each other and tin and lead. When the heterocyclic additives are used in combination with the polyether additives, a plating solution is obtained which permits high plating rates with excellent layer properties, such as smooth platings (freedom from dendritic growth) and constant plating thickness over wide areas.

DETAILED DESCRIPTION

1. Glossary of Components

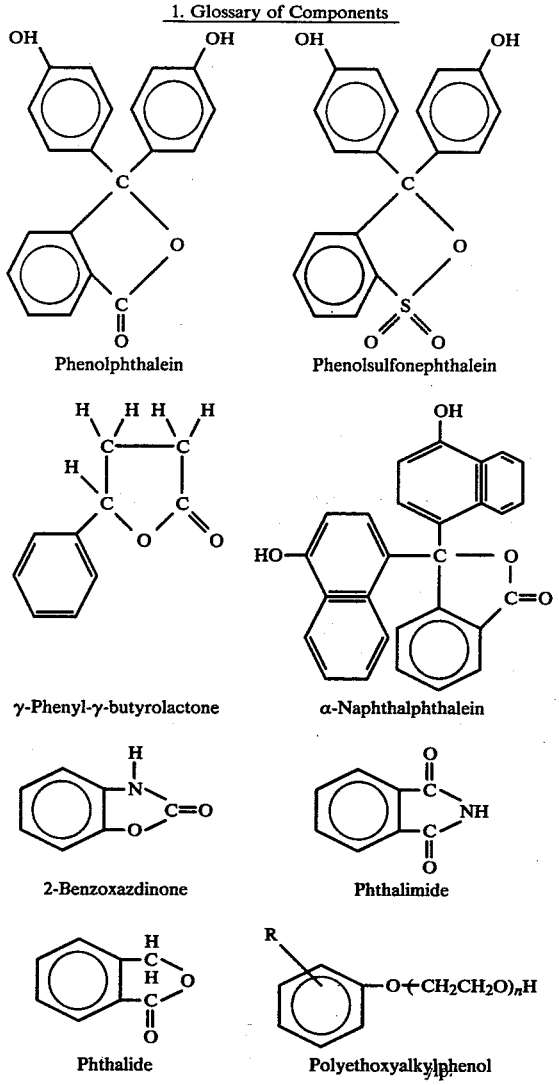

2. Heterocyclic Additives

The invention is an electroplating process in which one or more organic materials are present in the electroplating solution to insure high quality platings (smooth, bright, constant thickness) even at reasonably high plating rates (i.e., above 100 Amperes per square foot). The heterocyclic compounds are organic compounds with various specific types of ring structures. Included in the class of compounds are lactones (cyclic esters) with at least one aromatic substituent and up to 100 carbon atoms. Particular examples are phenolphthalein and phthalide. Other types of compounds included in the class of compounds are closely related to lactones. For example, lactams (cyclic amides) with at least one aromatic substitution are included. Lactams differ from lactones in that a nitrogen atom is substituted for the ring oxygen atom in the lactone structure.

Other groups of compounds that are closely related to lactones are included in the class of compounds useful as an additive in electroplating. For example, cyclic imides are closely related to lactones. A typical example is phthalimide. Also, oxazdinones such as 2-benzoxazdinone are useful in the practice of the invention. Particularly attractive are cyclic sulfate esters such as phenolsulfonephthalein (phenol red).

The compound should have at least one aromatic ring in the structure. This aromatic ring may be part of the cyclic structure (as with phthalide in the lactone structure) or separate from the cyclic structure as in 2 phenyl-2-butyrolactone.

The aromatic groups and other carbon atoms may have various substituents in place of hydrogen atoms. Such substituents may include hydroxyl groups, amine groups, carboxylic acid groups, halide groups (particularly bromine), aliphatic and aromatic groups with up to 10 carbon atoms.

The preferred compounds are those in which the cyclic structure (i.e., lactone or lactam structure) is attached to and partially made up of aromatic structure. This is the case with most of the compounds listed in the glossary (i.e., phthalide, phenolphthalein). Also preferred is the lactones because of availability, stability and low cost. Phenolphthalein is most preferred because it is extremely stable and readily available.

Concentration of the heterocyclic additive may vary over large limits. A concentration range from 0.005 to 5 g/liter gives excellent results. Smaller concentrations do not permit high speed plating without thickness variations in the platings. Higher concentrations do not improve the plating characteristics, and is wasteful of material. With phenolphthalein, a concentration of 0.1–0.2 g/liter is usually used.

To promote reasonable solubility of the heterocyclic additive (for example, phenolphthalein), a small amount of solvent that dissolves the additive and dissolves in the aqueous bath may be added. Typically, the additive is dissolved in alcohol and added as an alcohol solution.

3. Polyether Additives

It is advantageous to add another class of additives which further improves the quality of plating particularly at high plating rates. This class of compounds may be described as polyalkoxylated alkyl phenols in which the alkyl group may have from 1 to 20 carbon atoms. From 7 to 10 carbon atoms is preferred because of ease of availability and the high quality of plating obtained. The number of alkoxy groups should be between 4 and 50, with 8 to 12 preferred. In addition, polyethoxy groups are preferred because of availability and the excellent results obtained. Some are available under the tradename of TRITON ®. Most preferred is octyl phenoxy(10)polyethoxy ethanol because of the excellent plating characteristics (brightness, constant thickness, etc.) obtained even at very high plating rates.

A combination of the two types of additives (heterocyclic additives and polyether additives) yields exceptionally good results in that very smooth, bright platings with exceptionally constant thicknesses are obtained even at very high plating rates. Particularly important from the standpoint of fabricating integrated circuits and circuits mounted on printed wiring boards is the fact that plating occurs inside sharp crevices and holes even at high plating rates.

Concentration of the polyether additive may vary over large limits and still produce effective results. Generally, a concentration range from 0.2 to 20 g/liter is preferred. Below 0.2 g/liter, plating quality may decrease particularly at high plating rates. Above 20 g/liter, no advantages are obtained and the excess amount of material is wasteful. More than one polyether additive may be used. Generally, it is preferred that each additive have a concentration of at least 0.2 g/liter but the total of all additives be below 20 g/liter.

4. Bath Composition

A wide variety of bath compositions may be used including compositions that are conventional and well known in the literature. Many such compositions are contained in a book entitled *Electrodeposition of Alloys-Principles and Practice* and cited above. Another such reference is *Metal Finishing*, published by Metals and Plastics Publications, Inc., Hackensack, N.J. (1978).

The composition of the plating baths other than the additives described above are conventional. Generally, high speed plating solution compositions which favor high conductivity are preferred. Typical plating baths use fluoborate, sulfate, cyanide, chloride, etc.

For copper, typical bath components in addition to the additives described above are given below. Typical concentrations are also given.

| | |
|---|---|
| 1. Copper sulfate | 28–35 oz/gal |
| Sulfuric acid | 7–12 oz/gal |
| 2. Copper fluoborate | 30–60 oz/gal |
| pH | 0.3–2 |
| 3. Copper cyanide | 2–10 oz/gal |
| Sodium cyanide | 3–15 oz/gal |
| Sodium carbonate | 0–10 oz/gal |
| Sodium Hydroxide | 0–10 oz/gal |
| Copper cyanide | 45 g/l |
| Sodium cyanide | 65 g/l |
| Rochelle salt | 45 g/l |
| Potassium hydroxide | 15 g/l |

These baths may be operated over wide temperature ranges but usually are used between room temperature and the boiling temperature of the bath. Typical temperatures are 50 to 150 degrees F. Although the copper is usually replenished by a consumable anode, an inert anode may be used and copper replenished by the addition of copper salt.

A variety of baths may be used for zinc as well. Typically, sulfate, chloride, cyanide, and pyrophosphate are useful. A typical bath is as follows:

Zinc sulfate: 8 oz/gal

Metallic zinc: 2 oz/gal
Ammonium alum: 3–4 oz/gal
Potassium cyanide: 2–3 oz/gal
Caustic potash: 16 oz/gal Various nickel plating baths may be used including sulfate baths, chloride baths and combination sulfate-chloride baths. Nickel sulfamate baths are also useful. Typical baths are as follows:

Nickel sulfate ($NiSO_4.6H_2O$): 225 g/l
Nickel chloride ($NiCl_2.6H_2O$): 60 g/l
Boric Acid, $H_3$, $BO_3$: 37.5 g/l
pH (adjusted with $H_2SO_4$): 0.2–4.0

Amounts of substituents may vary over large limits and yield satisfactory results. Typical variations are ±50 weight percent. The nickel chloride may be left out where a consumable anode is not used. Typical plating temperatures are 40–60 degrees C.

Another typical bath is as follows:

Nickel sulfamate ($Ni(NH_2SO_3)_2$): 450 g/l
Boric acid: 30 g/l
pH (adjusted with sulfamic acid): 3–5

Where consumable nickel anodes are used, a small amount of nickel chloride may be added. Large variations in concentrations are permitted, typically variations of ±50 weight percent. Another nickel bath, particularly useful for nickel strikes, containing 216 g/l $NiCl_2$ $6H_2O$ and 100 ml/l of concentrated hydrochloric acid.

Various types of gold electroplating solutions may be used including phosphate buffered solutions and citrate buffered solutions. Two typical solutions are given below.

$KAu(CN)_2$: 20 g/l
$K_2HPO_4.3H_2O$: 40 g/l
$KH_2PO_4$: 10 g/l

Optimum plating temperature is 65± degrees C.

$KAu(CN)_2$: 20 g/l
$(NH_4)_2HC_6H_5O_7$: 50 g/l

Conductivity may be increased by adding (typically 50 g/l) $(NH_4)_2SO_4$. Optimum plating temperature is 65± degrees C. Strike baths generally have much lower gold concentrations and higher buffer concentrations.

Typical palladium baths use the diamino nitrite, the amino nitrate, the sulfamate and the alkaline bath. Typical baths are as follows:

$Pd(NH_3)_4$ $(NC_3)_2$: 40–100 g/l
Plating temperature: 100–140 deg F.
pH: 8–10

Pd $Cl_2$: 200 grams
Ammonium chloride: 3–5 oz
Water: One gal
Hydrochloric acid to pH: 0.1–0.5
Plating temperature: 100–120 deg F.

For platinum, a typical plating solution is as follows:

Ammonium nitrate: 13 oz
Sodium nitrate: 1.5 oz
Platinum (as the aminonitrate salt dissolved in ammonia): 10 grams
Ammonium hydroxide: 200 ml
Water: One gal
Preferred plating temperature: 205–215 deg F.

Two types of baths are useful for ruthenium plating, the nitroso salt bath and the sulfamate bath. Typical examples are as follows:

Ruthenium (as ruthenium nitroso chloride): 8 grams
Sulfuric acid: 80 ml
Water: One gal
Preferred plating temperature: 130–170 deg F.

Ruthenium (as ruthenium sulfamate): 20 grams
Sulfamic acid: 20 grams
Water: One gal
Preferred plating temperature: 80–120 deg F.

Many other bath compositions and plating conditions (temperature, current density, etc.) are contained in the references given above. The additives given above are in addition to the components given in the bath composition.

Plating rates may vary over large limits, usually from 1–1000 ASF or even higher. Even at low plating rates (say, below 20 ASF), the addition of these additives is advantageous because plating takes place at essentially uniform rates even in sharp crevices and holes. This is an important consideration in plating various articles, particularly electronic devices.

The various bath compositions with the additives are particularly advantageous for high speed plating, say above 100 ASF. Such platings are bright in appearance, smooth, free of dendritic or needle growth, and constant in thickness over wide areas. This is true even at plating rates of 100 ASF and above.

what is claimed is:

1. A process for electroplating a metallic substance consisting essentially of nickel comprising the step of passing current through an anode, an aqueous plating solution and a cathode CHARACTERIZED IN THAT the plating bath comprises a heterocyclic additive consisting essentially of phenolphthalein.

2. The process of claim 1 in which the heterocyclic additive consists essentially of phenolphthalein and the concentration of said phenolphthalein is from 0.005 g/l to 5.0 g/l.

3. The process of claim 2 in which the concentration of phenolphthalein is between 0.1 and 0.2 g/l.

4. The process of claim 1 in which the plating solution comprises in addition to the heterocyclic additive, a polyether additive which consists essentially of at least one organic compound selected from polyalkoxylated alkylphenols in which the alkyl group has from one to 20 carbon atoms and the number of alkoxy groups varies from 4 to 50.

5. The process of claim 4 in which the number of carbon atoms in the alkyl group is between 7 and 10, the alkoxy groups are ethoxy groups and the number of ethoxy groups is between 8 and 12.

6. The process of claim 5 in which the polyether additive is octylphenoxy(10)polyethoxyethanol with concentration range between 0.2 and 20 g/l.

* * * * *